US011879334B2

(12) United States Patent
Richards et al.

(10) Patent No.: US 11,879,334 B2
(45) Date of Patent: Jan. 23, 2024

(54) ROTARY STEERABLE SYSTEM WITH CUTTERS

(71) Applicant: Schlumberger Technology Corporation, Sugar Land, TX (US)

(72) Inventors: Edward Richards, Stonehouse (GB); Riadh Boualleg, Stonehouse (GB); Michael George Azar, The Woodlands, TX (US); Geoffrey Charles Downton, Stonehouse (GB); Denis Li, Cheltenham (GB); Richard D. Hill, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 43 days.

(21) Appl. No.: 17/503,412

(22) Filed: Oct. 18, 2021

(65) Prior Publication Data

US 2022/0034167 A1 Feb. 3, 2022

Related U.S. Application Data

(63) Continuation of application No. 16/328,315, filed as application No. PCT/US2019/015943 on Jan. 31, 2019, now Pat. No. 11,286,718.

(60) Provisional application No. 62/634,217, filed on Feb. 23, 2018.

(51) Int. Cl.
*E21B 7/06* (2006.01)
*E21B 17/10* (2006.01)

(52) U.S. Cl.
CPC ..... *E21B 7/06* (2013.01); *E21B 17/1078* (2013.01)

(58) Field of Classification Search
CPC ..... E21B 7/06; E21B 17/1078
See application file for complete search history.

(56) References Cited

U.S. PATENT DOCUMENTS

| | | | |
|---|---|---|---|
| 2,034,075 | A | 3/1936 | Wright |
| 4,386,669 | A | 6/1983 | Evans |
| 5,113,953 | A | 5/1992 | Noble |
| 5,265,682 | A | 11/1993 | Russell et al. |
| 5,520,255 | A | 5/1996 | Barr et al. |
| 5,553,678 | A | 9/1996 | Barr et al. |

(Continued)

FOREIGN PATENT DOCUMENTS

| | | | |
|---|---|---|---|
| CN | 204266924 | U | 4/2015 |
| WO | 2010092313 | A1 | 8/2010 |

(Continued)

OTHER PUBLICATIONS

Exam Report Under Section 18(3) in UK Patent Application No. GB2013200.7, dated Jan. 27, 2022, 6 pages.

(Continued)

*Primary Examiner* — Dany E Akakpo
(74) *Attorney, Agent, or Firm* — Jeffrey D. Frantz

(57) ABSTRACT

A rotary steerable tool may include a tool body with an upper end and a lower end. Additionally, the tool body may include at least one steering assembly extending from the tool body and includes at least one steering actuator configured to extend beyond other portions of the steering assembly. Furthermore, at least one cutter may be disposed on the rotary steerable tool a distance from the at least one steering actuator.

22 Claims, 5 Drawing Sheets

(56) References Cited

U.S. PATENT DOCUMENTS

| | | | |
|---|---|---|---|
| 5,553,679 | A | 9/1996 | Thorp |
| 5,582,259 | A | 12/1996 | Barr |
| 5,603,385 | A | 2/1997 | Colebrook |
| 5,673,763 | A | 10/1997 | Thorp |
| 5,685,379 | A | 11/1997 | Barr et al. |
| 5,695,015 | A | 12/1997 | Barr et al. |
| 5,706,905 | A | 1/1998 | Barr |
| 5,778,992 | A | 7/1998 | Fuller |
| 5,803,185 | A | 9/1998 | Barr et al. |
| 5,971,085 | A | 10/1999 | Colebrook |
| 6,089,332 | A | 7/2000 | Barr et al. |
| 6,092,610 | A | 7/2000 | Kosmala et al. |
| 6,158,529 | A | 12/2000 | Dorel |
| 6,244,361 | B1 | 6/2001 | Comeau et al. |
| 6,364,034 | B1 | 4/2002 | Schoeffler |
| 6,394,193 | B1 | 5/2002 | Askew |
| 7,188,685 | B2 | 3/2007 | Downton et al. |
| 7,845,430 | B2 | 12/2010 | Johnson et al. |
| 8,011,448 | B2 | 9/2011 | Tulloch et al. |
| 8,146,679 | B2 | 4/2012 | Downton |
| 8,157,024 | B2 | 4/2012 | De Paula Neves et al. |
| 8,469,104 | B2 | 6/2013 | Downton |
| 8,763,725 | B2 | 7/2014 | Downton |
| 10,557,311 | B2 | 2/2020 | Anderle et al. |
| 2001/0052428 | A1 | 12/2001 | Larronde et al. |
| 2002/0011359 | A1 | 1/2002 | Webb et al. |
| 2010/0038140 | A1 | 2/2010 | Johnson et al. |
| 2010/0038141 | A1 | 2/2010 | Johnson et al. |
| 2010/0092313 | A1 | 4/2010 | Suss et al. |
| 2013/0118812 | A1 | 5/2013 | Clausen et al. |
| 2015/0008043 | A1* | 1/2015 | Clausen ..... E21B 17/1014 175/57 |
| 2015/0060140 | A1 | 3/2015 | Downton |
| 2015/0330150 | A1 | 11/2015 | Strachan |
| 2015/0354280 | A1 | 12/2015 | Downton et al. |
| 2016/0084007 | A1 | 3/2016 | Seguira |
| 2017/0335631 | A1* | 11/2017 | Eddison ..... E21B 7/24 |
| 2021/0040796 | A1 | 2/2021 | Azar et al. |

FOREIGN PATENT DOCUMENTS

| | | | |
|---|---|---|---|
| WO | 2014099783 | A1 | 6/2014 |
| WO | 2016187372 | A1 | 11/2016 |

OTHER PUBLICATIONS

First Examination Report in Saudi Arabian Patent Application 520420016, dated Jan. 10, 2022, 5 pages.

Office Action and Search Report in Russian Patent Application No. 2020130916, dated Dec. 24, 2021, 17 pages.

International Search Report and Written Opinion in International Patent application PCT/US2019/015943, dated May 16, 2019, 14 pages.

Second Office Action issued in Chinese Patent Application No. 201900182072 dated Nov. 2, 2022, 9 pages.

Decision on Grant in Russian Patent Application No. 2020130916, dated Apr. 15, 2022, 19 pages.

First Office Action in Chinese Patent Application No. 201900182072, dated Jun. 1, 2022, 19 pages.

* cited by examiner

ROTARY STEERABLE SYSTEM WITH CUTTERS

CROSS REFERENCE TO RELATED APPLICATIONS

This application is a continuation of U.S. patent application Ser. No. 16/328,315, which entered the U.S. on Feb. 26, 2019 as a national stage entry of International Patent Application No. PCT/US2019/015943, filed Jan. 31, 2019, which claims priority to and the benefit of U.S. Patent Application No. 62/634,217, which was filed on Feb. 23, 2018. The entireties of each of the foregoing are incorporated herein by this reference.

BACKGROUND

Rotary drilling is defined as a system in which a bottom hole assembly, including the drill bit, is connected to a drill string which is rotatably driven from the drilling platform at the surface. When drilling holes in subsurface formations, it is sometimes desirable to be able to vary and control the direction of drilling, for example to direct the borehole towards a desired target, or to control the direction horizontally within the payzone once the target has been reached. It may also be desirable to correct for deviations from the desired direction when drilling a straight hole, or to control the direction of the hole to avoid obstacles. Further, steering or directional drilling techniques may also provide the ability to reach reservoirs where vertical access is difficult or not possible (e.g. where an oilfield is located under a city, a body of water, or a difficult to drill formation) and the ability to group multiple wellheads on a single platform (e.g. for offshore drilling).

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some embodiments, a rotary steerable tool includes a tool body and a steering assembly extending from the tool body that includes at least one steering actuator configured to extend beyond other portions of the steering assembly. A cutter may be disposed on the rotary steerable tool a distance from the at least one steering actuator. The rotary steerable tool, excluding the cutter, may have a first diameter, and the cutter may be located at a diameter greater than the first diameter.

In some embodiments, a bottom hole assembly includes a drill bit at an end of the bottom hole assembly and the drill bit includes a bit body with a plurality of cutting elements, the plurality of cutting elements including a plurality of gage cutters defining a gage of the bit. Additionally, the bottom hole assembly may include a steering unit at or spaced from a proximal end of the drill bit; the steering unit includes a steering assembly extending from a steering unit body, the steering assembly including a steering actuator configured to extend beyond the other portions of the steering assembly. A cutter on the steering unit is at a distance from the steering actuator, and is configured to cut at the same diameter as the plurality of gage cutters or is configured to cut at a diameter greater than the plurality of gage cutters.

In some embodiments, a bottom hole assembly includes a drill bit at a distal end of the bottom hole assembly and the drill bit includes a bit body with a plurality of cutting elements thereon. The plurality of cutting elements include a plurality of gage cutters defining a gage of the bit. Additionally, the bottom hole assembly may include a steering unit at or spaced from a proximal end of the drill bit and the steering unit includes a steering assembly extending from a steering unit body. The steering assembly includes at least one steering actuator configured to extend beyond the other portions of the steering assembly. A cutter is on the steering unit and is configured to cut at the same diameter as the plurality of gage cutters or is configured to cut at a diameter greater than the plurality of gage cutters. A distance between the cutter and an upper most gage cutting element of the drill bit is equal to or greater than 6 inches (15 cm).

In some embodiments, a method of drilling a curved hole within a wellbore includes drilling the wellbore with a drill bit and rotating a rotary steerable tool having at least one cutter thereon within the wellbore above the drill bit. Additionally, the method may include selectively actuating the rotary steerable tool to deflect the drill bit in a direction from the wellbore, thereby drilling the curved hole within the wellbore and cutting the curved hole with the cutter.

Other aspects and advantages will be apparent from the following description and the appended claims.

DETAILED DESCRIPTION

Figure 1:
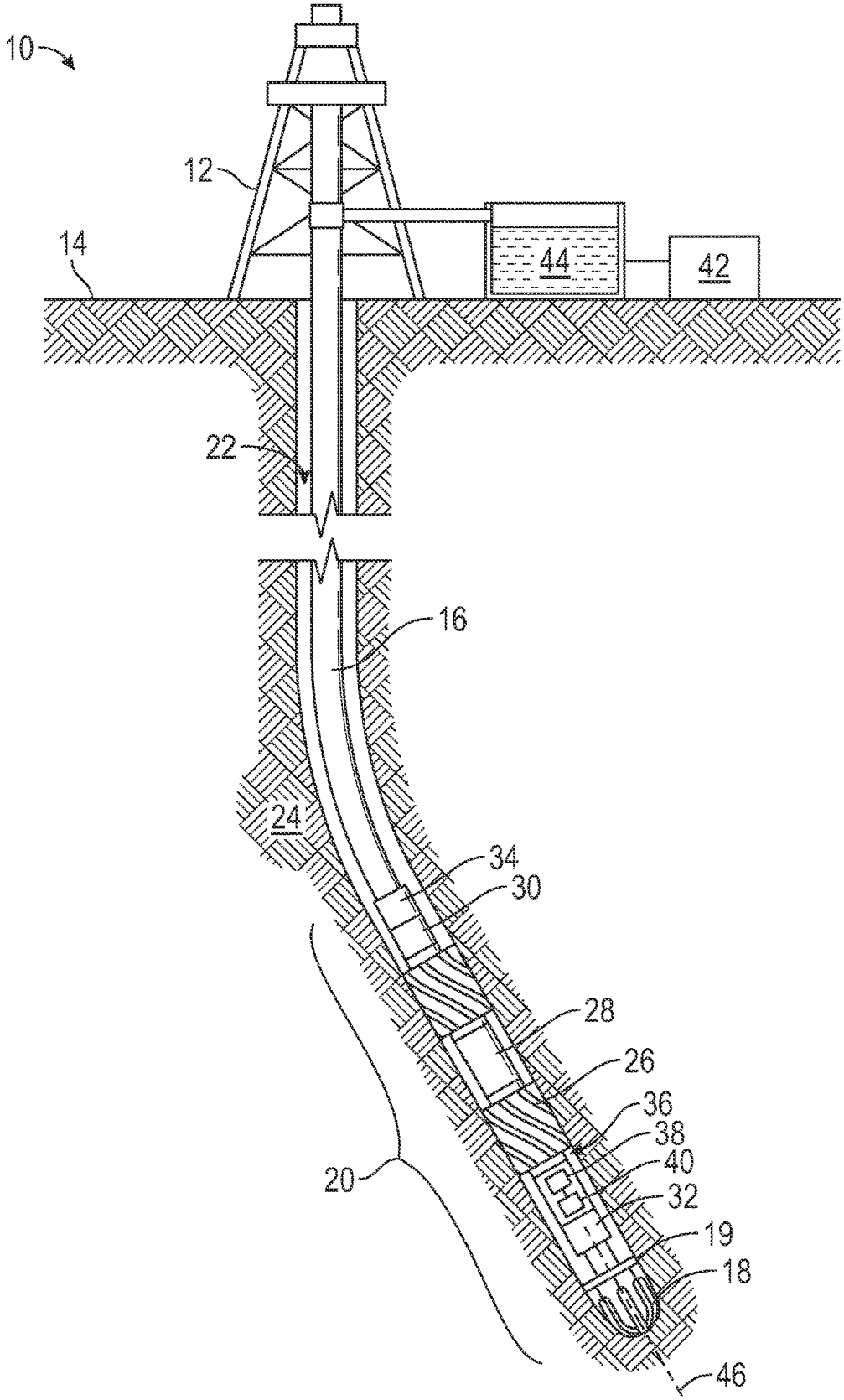
FIG. 1 illustrates a diagrammatic sectional representation of a wellbore drilling installation.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Further, embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in various environments, such as land or sub-sea, without departing from the scope of the present disclosure. The embodiments are described merely as examples of useful applications, which are not limited to any specific details of the embodiments herein.

Referring to FIG. 1, in one or more embodiments, a drilling system, generally denoted by the numeral 10, in which embodiments of the disclosure may be incorporated is illustrated. Drilling system 10 includes a rig 12 located at a surface 14 and a drill string 16 suspended from rig 12. A lower drill bit 18 is disposed with a bottom hole assembly ("BHA") 20 and deployed on drill string 16 to drill (i.e., propagate) borehole or wellbore 22 into formation 24 at a distal end of the BHA 20. A secondary or upper drill component 19, e.g. reamer, is mounted above the lower drill bit 18 (i.e., pilot bit). For example, the upper drill component 19 may have a larger diameter than the lower drill bit 18 such that, in normal use, the lower drill bit 18 cuts a hole of a diameter smaller than the desired gage diameter and the upper drill component 19 serves to increase the diameter of the hole to the desired gage.

The depicted BHA 20 includes one or more stabilizers 26, a measurement-while-drilling ("MWD") module or sub 28, a logging-while-drilling ("LWD") module or sub 30, and a rotary steerable tool 32 (e.g., bias unit, RSS device, steering actuator, pistons, pads), and a power generation module or sub 34 (e.g., mud motor). The illustrated directional drilling system 10 includes a downhole steering control system 36, e.g. an attitude hold controller or control unit, disposed with BHA 20 and operationally connected with the rotary steerable tool 32 to maintain drill bit 18 and BHA 20 on a desired drilling attitude to propagate wellbore 22 along the desired path (i.e., target attitude). Depicted downhole steering control system 36 includes a downhole processor 38 and sensors 40, for example, accelerometers and magnetometers. Downhole steering control system 36 may be a closed-loop system that interfaces directly with BHA 20 sensors, i.e., D&I sensors 40, MWD sub 28 sensors, and the rotary steerable tool 32 to control the drill attitude. Downhole steering control system 36 may be, for example, a unit configured as a roll stabilized or a strap down control unit. Presently, there are various directional drilling systems available. Most common are "rotary steerable systems" or "RSS." RSS systems can include push the bit systems, point the bit systems, and hybrid systems that combine push the bit and point the bit systems. Drilling system 10 includes drilling fluid or mud 44 that can be circulated from surface 14 through the axial bore of drill string 16 and returned to surface 14 through the annulus between drill string 16 and formation 24.

The tool's attitude (e.g., drill attitude) is generally identified as the axis 46 of BHA 20. Attitude commands may be inputted (i.e., transmitted) from a directional driller or trajectory controller generally identified as the surface controller 42 (e.g., processor) in the illustrated embodiment. Signals, such as the demand attitude commands, may be transmitted by any suitable method, for example, via mud pulse telemetry, RPM variations, wired pipe, acoustic telemetry, electromagnetic telemetry, or wireless transmissions. Accordingly, upon directional inputs from surface controller 42, downhole steering control system 36 controls the propagation of wellbore 22 for example by operating the rotary steerable tool 32 to steer the drill bit and to create a deviation, dogleg or curve in the borehole along the desired trajectory. In particular, the rotary steerable tool 32 is actuated to drive the drill bit to a set point. The steering device or bias unit may be referred to as the main actuation portion of the directional drilling tool and may be categorized as a push-the-bit, point-the-bit, or hybrid device.

The rotary steerable tool 32 can be a point-the-bit (e.g., POWERDRIVE XCEED a trademark of Schlumberger), push-the-bit (e.g., POWERDRIVE ORBIT a trademark of Schlumberger) or a hybrid combination (e.g., POWERDRIVE ARCHER a registered trademark of Schlumberger). In the case of push actuators, the actuators could be mounted on the motor-stator bearing housing, a sub above the bit or even on the bit itself like a pad-in-bit. Also, the steering pad actuators could be on a freely rotating sleeve, mounted on or close to the bit or on a mud motor body (e.g. stator). The drill bit may be driven (rotated) from the surface or by a downhole rotary motive force such as a mud motor, turbine, electric motor etc. A non-limiting example of controllable drilling motor is a servoed motor, such as described in US 2015/0354280; WO 2014/099783A1; US 2015/0354280; U.S. Pat. Nos. 6,089,332; 8,469,104; and 8,146,679, the entire teachings of which are incorporated herein by reference.

In point-the-bit devices, the axis of rotation of the drill bit 18 is deviated from the local axis 46 of the bottom hole assembly 20 in the general direction of the desired path (target attitude). The borehole is propagated in accordance with the customary three-point geometry defined for example by upper and lower stabilizers and the hole reaming cutters, for example the upper cutter 19. The angle of deviation of the drill bit axis coupled with a finite distance between the lower and middle touch points results in the non-collinear condition for a curve to be generated. There are many ways in which this may be achieved including a fixed bend at a point in the bottom hole assembly close to the lower stabilizer or a flexure of the drill bit drive shaft distributed between the upper and lower stabilizer. Examples of point-the-bit type rotary steerable systems, and how they operate are described in U.S. Patent Application Publication Nos. 2002/0011359; and 2001/0052428 and U.S. Pat. Nos. 6,394,193; 6,364,034; 6,244,361; 6,158,529; 6,092,610; and 5,113,953, the entire teachings of which are incorporated herein by reference.

In the push-the-bit rotary steerable system, the requisite non-collinear condition is achieved by causing either or both of the upper or lower stabilizers to apply an eccentric force or displacement in a direction that is preferentially orientated with respect to the direction of the borehole propagation. There are many ways in which this may be achieved, including non-rotating (with respect to the hole) eccentric stabilizers (displacement based approaches) and eccentric actuators that apply force to the drill bit in the desired steering direction. Steering is achieved by creating non co-linearity between the drill bit and at least two other touch points. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085, the entire teachings of which are incorporated herein by reference.

The drilling system may be of a hybrid type, for example having a rotatable collar, a sleeve mounted on the collar so as to rotate with the collar, and a universal joint permitting angular movement of the sleeve relative to the collar to allow tilting of the axis of the sleeve relative to that of the collar. Actuators control the relative angles of the axes of the sleeve and the collar. By appropriate control of the actuators, the sleeve can be held in a substantially desired orientation while the collar rotates. Non-limiting examples of hybrid systems are disclosed for example in U.S. Pat. Nos. 8,763,725 and 7,188,685, the entire teachings of which are incorporated herein by reference.

"Micro-steering" systems require the steering offset to be positioned close to the bit's cutting structure. This may be challenging, whether for a conventional RSS or a steerable motor, because even the short lengths of the breaker slots (e.g. tong space), bearing assembly, or bit-gage, have an impact (e.g., in some instances, a significant impact) on dogleg capability. To a rough first order, the dogleg severity (DLS) capability or curvature response of a stiff three point steering assembly is DLS=2*ecc/(L1*L2). Where the steering offset, or eccentricity (ecc), occurs a distance L1 from the cutting structure axially below the steering unit (lower touch point) and L2 from the effective upper stabilizer touch point, which may be the collar itself for a slick assembly. DLS is inversely proportional to L1 and L2. However, in practice L1 is usually much shorter than L2, thus a few inches off L1 has a much greater DLS impact than a similar change in L2. DLS is also proportional to eccentricity: doubling the stroke of the actuator doubles the DLS. If the actuator runs out of travel to deviate the well due to borehole erosion, then that determines the system's dogleg capability even if ample pad force is available, although being wasted on pushing against the limit of travel stops. Some embodiments of the present disclosure are directed to reducing the L1, and as a result increasing the DLS. L1 may be reduced by incorporating cutting structures axially above the gage cutters present on the drill bit face.

Figure 2:
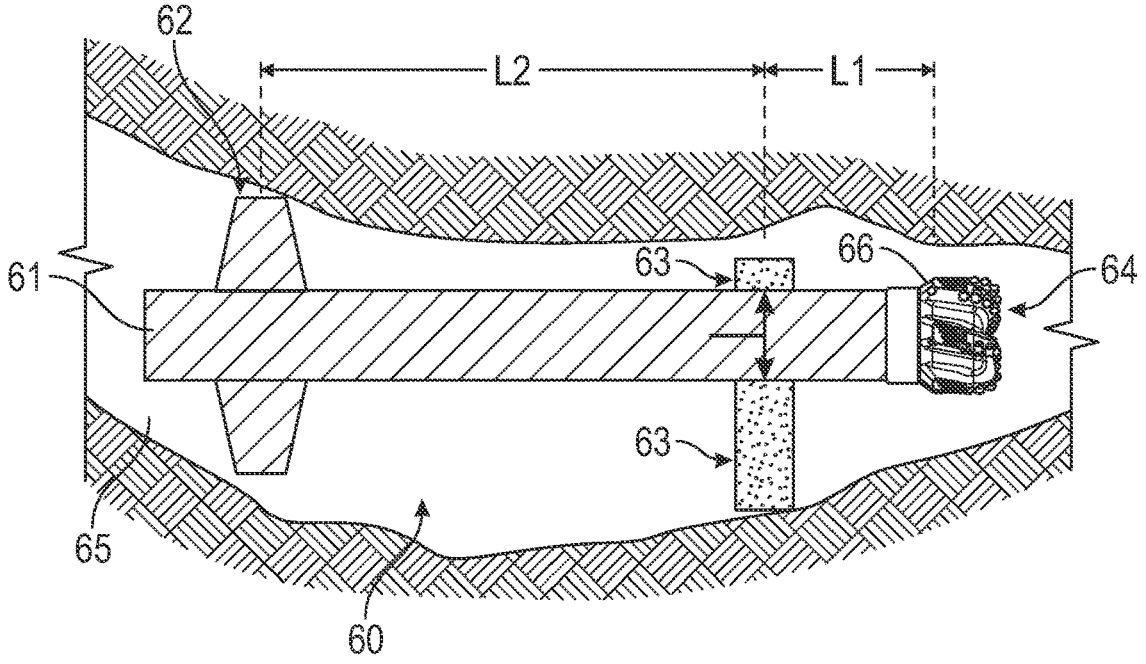
FIG. 2 (Prior Art)
FIG. 2 illustrates a schematic view of a rotary steerable system according to the prior art.

FIG. 2 shows a conventional rotary steerable system 60, according to the prior art, includes a RSS tool 61 connected to a drill bit 64 in the wellbore 65. The RSS tool 61 has an upper stabilizer 62 (which may be the RSS tool 61 for a slick assembly) and one or more steering pads 63 disposed on the RSS tool 61. The one or more steering pads 63 are placed further downhole on the RSS tool 61 than the upper stabilizer 62. Additionally, the upper stabilizer 62 creates an upper contact point for the rotary steerable system 60. The one or more steering pads 63 of the RSS tool 61 provide the steering offset for the conventional rotary steerable system 60. The conventional rotary steerable system 60 may become a "Micro-steering" system by reducing L1, which requires the steering offset to be positioned close to a last cutting element 66 of the drill bit 64. However, due to lengths of a breaker slots (e.g. tong space), bearing assembly, or bit-gage length, and other factors that require adding length between the cutting structure and the steering assembly, dogleg capability may be reduced. A dogleg severity (DLS) capability or curvature response of a stiff three point steering assembly is characterized by Equation 1 as followed:

$$DLS=2*ecc/(L1*L2) \quad (1)$$

wherein:

DLS=dogleg severity (1/m);

ecc=steering offset (m);

L1=distance from last cutting structure and steering pad (m); and

L2=distance from steering pad and upper contact point (m).

Still referring to FIG. 2, in the conventional rotary steerable system 60, L1 from equation 1 is the distance from the last hole defining cutting element, e.g., in some cases, it could be cutting element 66 of the drill bit 64 to the bottom of the portion of the one or more steering pads 63 that engages the formation. Additionally, L2 is the distance from the top of the portion of the one or more steering pads 63 that engages the formation to the upper stabilizer 62. As shown by Equation 1, the DLS is inversely proportional to L1 and L2. In practice, L1 is usually much shorter than L2, thus a few inches/centimeters off L1 has a much greater DLS impact than a similar change in L2. Additionally, the DLS is also proportional to eccentricity, for example, doubling a stroke of the steering pads doubles the DLS. In the conventional rotary steerable system 60, steering actuation and formation heterogeneity can cause micro spiraling and dog legs. Micro dog legs can be detrimental to the reliability and performance of the conventional rotary steerable system 60, especially in interbedded and abrasive formations due to contact between the one or more steering pads 63 and a formation of the wellbore 65.

With reference to FIGS. 3-7, in some embodiments, the rotary steerable tool 32 remains at a reasonable distance from a bit face 25, and an additional cutting structure is placed in closer proximity to the steering actuators 53. In some embodiments, the rotary steerable tool 32 is used on a push-the-bit rotary steerable system with one or more steering assemblies. The one or more steering assemblies may have one or more one steering actuators and one or more active or passive cutters on the one or more steering assemblies. Additionally, the steering actuators 53 of the rotary steerable tool 32 remain at a distance from the bit face 25, and a final hole trimming cutting structure 57 (e.g., cutters) is a distance from an upper most hole defining cutting element 79 of the drill bit 18. As used herein, upper most hole defining cutting element is a cutting element that is on the bit and is a cutting element that is positioned such that it extends to the gage or outermost diameter of the bit). In some embodiments, the depicted back reaming cutting element 79 may not be a hole defining cutting element as it may be placed at a location that is under gage or at a diameter that is less than the gage of the bit. In some embodiments, the upper most gage cutter 78 may be the upper most hole defining cutting element 79. The dogleg of a borehole generated by a drilling tool can be determined by the cutting structure that cuts the final wellbore diameter, effectively defining L1. In some embodiments, the rotary steerable tool 32 may be able to achieve increased DLS, better wellbore quality, and improved durability to the steering assembly in abrasive applications. In contrast, in embodiments where cutters 57 are below the gage of the drill bit, while durability of the steering assembly may be improved, increased DLS and wellbore quality improvements are less likely to be achieved.

Figure 3:
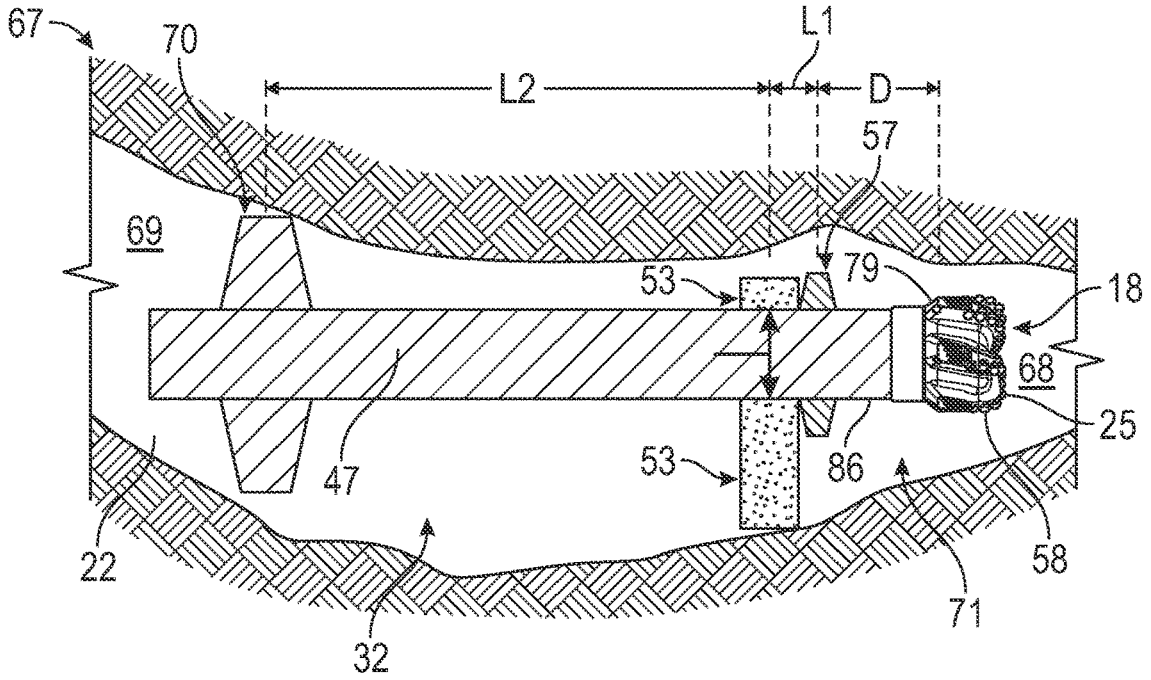
FIG. 3 illustrates a schematic view of a rotary steerable system according to one or more embodiments of the present disclosure.

Referring to FIG. 3, in one more embodiments, the rotary steerable tool 32 is illustrated in a rotary steerable system 67 in the wellbore 22. At a bottom end 68 of the wellbore 22, the drill bit 18 is further cutting the wellbore 22. At a proximal end 69 of the rotary steerable system 67, the rotary steerable tool 32 may have stabilizer blades 70 or a slick body to form an upper contact point of the rotary steerable system 67. The cutters 57 may be disposed directly to the rotary steerable tool 32 or on a sleeve, in which the sleeve slides over on an outer surface of the rotary steerable tool 32 and then is threaded or bolted to be removably attached on the rotary steerable tool 32. As stated above, the cutters 57 are placed a distance L1 from the one or more steering actuators 53 and more specifically, the cutters 57 are above the drill bit 18 at a distance D from the upper most hole defining cutting element 79 of the drill bit 18; therefore, the cutters 57 are the last cutting structure of the rotary steerable system 67. In one or more embodiments, the distance D is equal to or greater than 4 inches (10 cm), 6 inches (15 cm), or 9 inches (23 cm). Thus, there is an axial region 86 (or a gap) that exists between the bit 18 and the cutters 57. Such region may have a diameter that is less than the bit gage (e.g., the outermost diameter of the drill bit as defined by the outermost cutting elements on the drill bit). In one or more embodiments, the axial region contains no cutting elements that are present at or greater than the bit diameter and/or the axial region contains no passive load bearing surface that is present at or greater than the bit diameter. In other words, this axial region contains no cutting elements or passive load bearing surfaces that are at or beyond the bit gage. In some embodiments, the axial region 86 does not include any cutting elements or passive load bearing surfaces that consistently engage the formation, e.g., while drilling a curve. However, in this axial region, there may optionally be cutting elements or a passive load bearing surface that are at a radius less than the bit gage. Further, in one or more embodiments, the distance L1 (the distance between the cutters 57 and the steering actuators 53) is less than the distance D. In particular embodiments, when multiple cutters 57 are present, the distance between the lowermost cutters of the cutters 57 and the lower edge of the lowest steering actuator 53 is less than distance D.

As such, when equation 1 is applied to the rotary steerable system 67 of FIG. 3, L1 is the distance from the cutters 57 to the one or more steering actuators 53 and L2 is the distance from the one or more steering actuators 53 to the stabilizer blades 70. Therefore, as applied to equation 1, due to the reduction of L1, the rotary steerable system 67 has an improved dog leg capability over the conventional rotary steerable system 60. In some embodiments, there may be an intermediate passive surface 71 between the drill bit 18 and the one or more steering actuators 53 to provide lateral stabilization and to provide a maximal constraint on achieved DLS (i.e., prevents excessive DLS response). Additionally, the rest of the BHA, which is coupled to the rotary steerable system 67, may also have multiple intermediate passive surfaces. The intermediate passive surfaces (71) may not impede the lateral progress of the borehole 22 towards a desired terminal dogleg, and thus, the intermediate passive surfaces (71) may be profiled to suit a terminal borehole curvature. Additionally, the cutters 57 may be at a diameter with respect to the axis of the tool that is that is the same as (e.g., the same as or substantially the same as, e.g., within manufacturing tolerances such as +/−0.025 in (0.64 mm), +/−0.050 in (1.3 mm), or +/−0.100 in (2.54 mm)), or greater than the diameter of the gage of the drill bit with respect to the axis of the bit. In other words, the cutters may be located at the same radial position as the gage cutters or may be located at a radial position that extends beyond the radial position of the gage cutters. As the bit is drilling through a curved portion, the bit may not drill the hole to the intended gage. In some embodiments, by placing the cutters 57 at or beyond the bit gage, the cutters 57 may effectively cut or ream the borehole to the intended gage of the wellbore through the curved portion. The cutters 57 may effectively ream any formation abrasions and prevent contact of the formation abrasions to sensitive parts (i.e., assemblies not designed for formation contact) of the rotary steerable tool 32. In some embodiments, the cutters 57 placed on the tool body 47 and radially near the wellbore's nominal diameter achieves increased dog leg capability, improves bore hole quality, and enhances the durability and reliability of the rotary steerable system 67.

The rotary steerable tool 32, including the actuators 53 and any other components described in other embodiments, has a first diameter when the steering actuators are not actuated. The cutters 57 are placed on the rotary steerable tool 32 at a diameter that is greater than the first diameter. In other words, the rotary steerable tool 32, including all components but excluding the cutters 57, have a first diameter, and the cutters 57 are placed such that they extend (i.e., the cutting face extends) beyond the first diameter.

Figure 4:
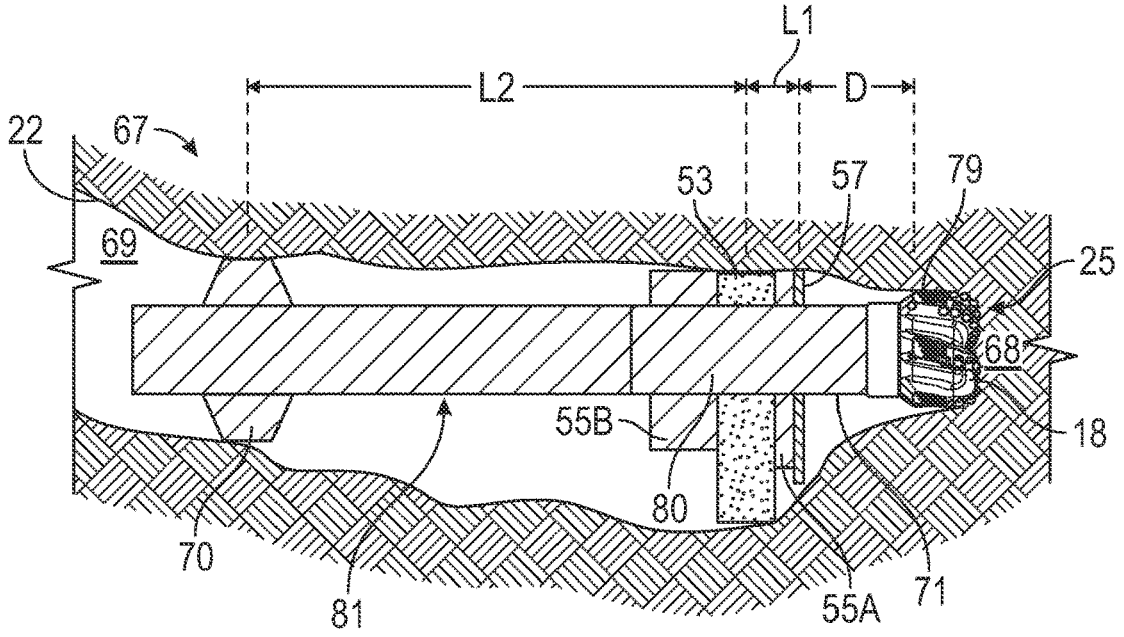
FIG. 4 illustrates a schematic view of a rotary steerable system according to one or more embodiments of the present disclosure.

As shown in FIG. 4, a rotary steerable tool 80 is illustrated in a rotary steerable system 67 in the wellbore 22. At a bottom end 68 of the wellbore 22, the drill bit 18 is cutting the wellbore 22. A stabilizer 70 is at a proximal end 69 of rotary steerable system 67, above rotary steerable tool 80 to form an upper contact point of the rotary steerable system 67, with an intermediate passive (under gage) surface 81 therebetween. On the rotary steerable tool 80, the cutters 57 are placed adjacent to, such as below, the one or more steering actuators 53. The cutters may be mounted directly to a body of the rotary steerable tool 80 or disposed on one or more secondary pads (55A, 55B) and bolting the one or more secondary pads (55A, 55B) to the rotary steerable tool 80. For example, the cutters 57 may be on mounted on a lower secondary pad 55A and the lower secondary pad 55A is placed below the one or more steering actuators 53 of the rotary steerable tool 80. With the cutters 57 on the lower secondary pad 55A, the cutters 57 may act as a full gage reamer. Instead of, or in addition to the use of the secondary pads, the cutters 57 may be disposed on a sleeve, in which the sleeve slides or is threaded on an outer surface of the rotary steerable tool 80.

Still referring to FIG. 4, there may be an intermediate passive surface 71 between the drill bit 18 and the one or more steering actuators 53 to provided lateral stabilization and to provide a maximal constraint on achieved DLS (i.e., prevents excessive DLS response). Additionally, the rest of the BHA, which is coupled to the rotary steerable system 67, may also have multiple intermediate passive surfaces. One skilled in the art will appreciate that the intermediate passive surfaces 71 may not impede the lateral progress of the borehole 22 towards a desired terminal dogleg, and thus, the intermediate passive surfaces 71 may be profiled to suit a terminal borehole curvature. Further, the intermediate passive surfaces 71 may have a diameter less than the gage diameter of the drill bit 18. Additionally, the cutters 57 may be placed at a diameter that is greater than or equal to an outer diameter of the cutting structure of the drill bit 18. As noted above, in some embodiments, this may ensure that the desired borehole diameter is achieved (e.g., these cutters may nominally gage ream the curved portion of the wellbore 22 to the desired diameter of the wellbore 22). The cutters 57 may also effectively ream any formation abrasions and prevent contact of the formation abrasions to sensitive parts (i.e., assemblies not designed for formation contact) of the rotary steerable tool 32. When Equation 1 is applied to the rotary steerable system 67 of FIG. 4, L1 is the distance from the cutters 57 to the one or more steering actuators 53 and L2 is the distance from the one or more steering actuators 53 to the stabilizer 70; thus, as applied to equation 1, the rotary steerable system 67 has an improved dog leg capability over the conventional rotary steerable system 60.

Figure 5:
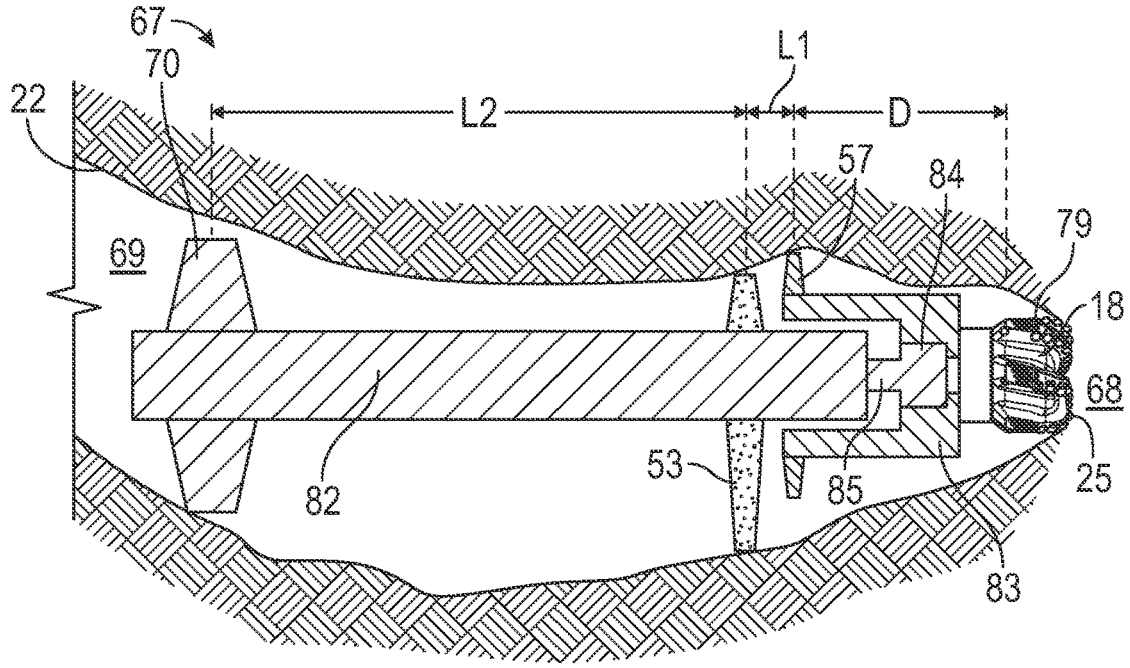
FIG. 5 illustrates a schematic view of a rotary steerable system according to one or more embodiments of the present disclosure.

As shown in FIG. 5, in one or more embodiments, the rotary steerable system 67 is illustrated utilizing a top hat or a sleeve 83 to position the cutters 57 above drill bit 18, adjacent to steering actuators 53. As illustrated, the drill bit 18 is connected to a bit box 84, which may be deployed on the BHA, e.g., at the bottom of the tool, and in some embodiments, may be connected to an end of a motor drive shaft 85 of a mud motor 82. Additionally, the sleeve 83 may be threaded to the bottom of the tool or to a body of the mud motor 82 or it may be operationally connected with the bit box 84. For example, the sleeve 83 may be keyed to a motor drive shaft 85 to enable threading the drill bit 18 to the bit box 84 without rotating a rotor of the mud motor 82. The sleeve 83 and the bit box 84 may have mutually interlocking keying features to allow a bit breaker (e.g., tongs) to restrain rotation while the drill bit 18 is being torqued to connect it to the drill string. In this example, the one or more steering actuators 53 may be eccentric offset pads to function as steering offsets. For example, the eccentric offset pad may be a simple fixed kick-pad arrangement, an on-demand kick-pad (to switch from kick to straight), or a full rotary steerable system where the pads are synchronously extended and contracted with a motor stator rotation at a phase angle consistent with the direction of steering. For further non-limiting examples, see US 2015/0060140, which is incorporated by reference in its entirety. The cutters 57 (i.e., final reaming cutting elements) are positioned below and adjacent to the one or more steering actuators 53 (e.g., eccentric offset pad).

As stated above, the cutters 57 are placed a distance from the one or more steering actuators 53 and more specifically, the cutters 57 are above the drill bit 18 at a distance D from the upper most hole defining cutting element 79 of the drill bit 18. Therefore, the cutters 57 are the last cutting structure of the rotary steerable system 67. In some embodiments, the distance D is equal to or greater than 4 inches (10 cm), 6 inches (15 cm), or 9 inches (23 cm). As used herein, when the final hole trimming elements (e.g., cutters 57) that define the hole size are separated from the primary cutting element (e.g., drill bit 18), the hole reaming elements (e.g., cutters 57) may be spaced apart from the steering mechanism (e.g., the one or more steering actuators 53) by a distance less than the distance D. As such, when Equation 1 is applied to the rotary steerable system 67 of FIG. 5, L1 is the distance from the cutters 57 to the one or more steering actuators 53 and L2 is the distance from the one or more steering actuators 53 to stabilizer blades 70 of the mud motor 82. Thus, as applied to Equation 1, the rotary steerable system 67 has an improved dog leg capability over the conventional rotary steerable system 60. In some embodiments, by placing the one or more steering actuators 53 on the body of the mud motor 82, the rotary steerable system 67 may reduce pad abrasion of the borehole by limiting the surface RPM, to zero in some cases. Additionally, this also allows bit speed to be selected without fear of wearing out either the one or more steering actuators 53 or the formation. As with the previously described embodiments, cutters 57 placed on the mud motor 82 and radially near the wellbore' s nominal diameter achieves increased dog leg capability, improves bore hole quality, and enhances the durability and reliability of the rotary steerable system 67.

Additionally, one skilled in the art will appreciate how the rotary steerable system 67 may incorporate any combination of FIGS. 3-5 in the BHA 20 along with other downhole tools known in the art without departing from the scope of the present disclose. The schematic views shown in FIGS. 3-5 show the one or more steering actuators 53 that rotate with the drill bit 18, however, the scope of the present disclosure is not limited to the one or more steering actuators 53 rotating with the drill bit 18. In some embodiments, the one or more steering actuators 53 may be mounted on a non-rotating stabilizer in the BHA 20.

Figure 6:
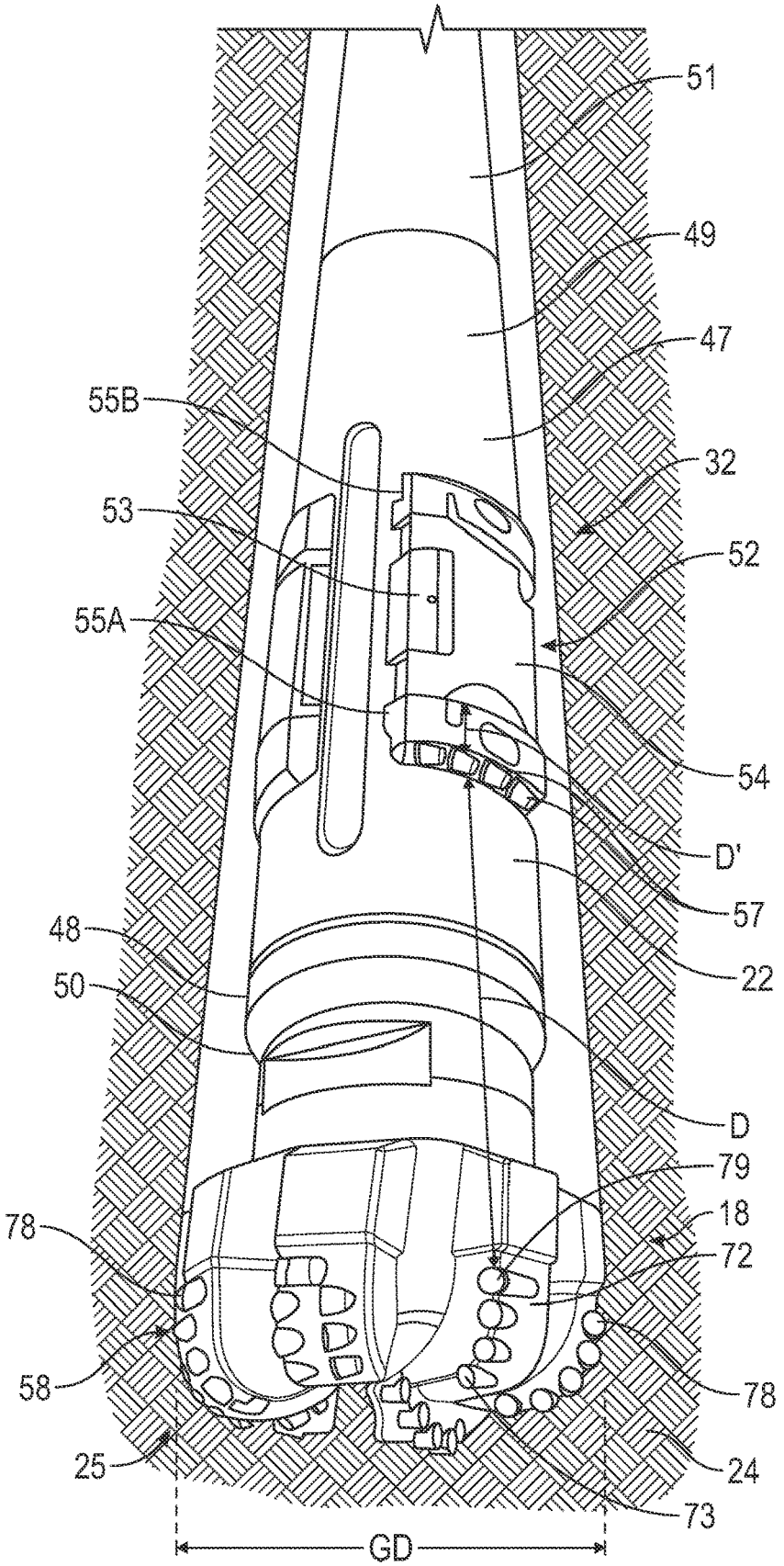
FIG. 6 illustrates a rotary steerable system according to one or more embodiments of the present disclosure.

FIG. 6 illustrates a rotary steerable tool 32 or a steering unit within the wellbore 22. The rotary steerable tool 32 includes a tool body 47 with a lower connection end 48 and an upper connection end 49. The lower connection end 48 and the upper connection end 49 may be a male (pin) connection, a female (box) connection, or any combination thereof. For example, in some embodiments, the lower connection end 48 is a box connection coupled to a proximal end 50 (i.e., pin connection) of the drill bit 18 opposite of the bit face 25. In this embodiment, the drill bit 18 may have a cutting face (i.e., bit face 25) and a gage surface 72. The drill bit 18 may include a plurality of blades 58 that extend radially from a bit body that are equipped with cutting elements 73 configured to degrade the formation 24. Gage cutters 78 define the hole diameter drilled by the bit 18. Fluid from drill bit nozzles may remove formation fragments from the bottom of the wellbore and carry them up the wellbore 22. The drill bit 18 may be any known drill bit in the art without departing from the scope of the present disclose (e.g., fixed cutter polycrystalline diamond bit, roller cone bit, etc.). Drill bit 18 may be elongated so that it covers the connection to the rotary steerable tool 32 (e.g., in the top-hat design shown in FIG. 5, the cutting structure may extend around and over bit box 84). Additionally, the upper connection end 49 may be a pin or box connection configured to be coupled to a downhole tool 51 of the BHA, such as, a drill collar, stabilizer sub, or any above mentioned tool. While the connections themselves are not specifically shown, pin and box connections would make-up to create a flush seal with a shoulder face of the respective connection. Furthermore, the connections may be any standard API or specialized connection, and may be, e.g., threaded or not threaded.

In some embodiments, the rotary steerable tool 32 may have one or more steering assemblies 52 extending from the tool body 47. The one or more steering assemblies 52 may include one or more steering actuators 53 to extend beyond the one or more steering assemblies 52. The one or more steering actuators 53 may be disposed on the tool body 47. Additionally, the one or more steering actuators 53 may have an actuatable bias pad 54 to provide a drilling offset in a push-the-bit rotary steerable system. For example, the steering actuator 53 may include a piston within a chamber of the one or more steering assemblies 52 configured to move a hinged actuatable bias pad 54 pad from a retracted position to an extended position to provide the steering offset. Alternatively, the hinged pad 54 may be configured with a ball piston actuation to move the hinged pad. Non-limiting example of ball piston steering devices are disclosed for example in U.S. Pat. No. 8,157,024, the entire teaching of which is incorporated herein by reference. Any suitable actuation method for the bias pad 54 may be used. Furthermore, the rotary steerable tool 32 may include a controller that controls actuation of the pad 54. The one or more steering assemblies 52 may have one or more secondary pads (55A, 55B) disposed adjacent to the actuatable bias pad 54. The secondary pads may be part of the steering assembly and may be a portion of the hinge about which the pad 54 rotates. In addition, the secondary pads may help protect the actuatable bias pad 54 and other portions of steering assembly 52. In some embodiments, a lower secondary pad 55A is disposed below the actuatable bias pad 54 (towards the drill bit 18) and an upper secondary pad 55B is disposed above the actuatable bias pad 54 towards the downhole tool 51. The one or more secondary pads (55A, 55B) may be active or passive. Passive secondary pads may be permanently or removably attached to the tool body 47 at a fixed outer diameter. Unlike passive secondary pads, active secondary pads do not have a fixed outer diameter and may be actuated to various outer diameters while down hole. However, the secondary pads (55A, 55B) are not limited to being adjacent to the actuatable bias pad 54 and may be otherwise integral with or attached anywhere to (i.e., welded, hardbanded, casted, or molded on) the tool body 47. Additionally, the secondary pads (55A, 55B) may also be rotationally displaced from the actuatable bias pad 54 and the number of the secondary pads may be different from the number of bias pads.

Still referring to FIG. 6, in one or more embodiments, one or more cutters 57 are disposed on the rotary steerable tool 32. For example, cutters 57 may be located on one or more steering assemblies 52. In some embodiments, the cutters 57 may be attached to the lower secondary pad 55A, i.e., proximate a lower connection end 48 of the tool or the distal end of the BHA. While FIG. 6 shows the cutters 57 on the lower secondary pad 55A, the cutters 57 are not limited to be placed on the lower secondary pad 55A. Rather, the cutters 57 may be on one or more steering assemblies 52 adjacent to the lower connection end 48 and/or the upper connection end 49 of the tool body 47, such as upper secondary pad 55B. Placement of cutters 57 on steering assembly 52 may allow for the cutters 57 to be located in relative close proximity to steerable actuator 53, thereby providing for a reduced L1 distance and increased DLS. Further, while FIG. 6 shows cutters 57 on steering assemblies 52, specifically lower secondary pad 55A of steering assemble 52, the present disclosure is not so limited. Rather, one or embodiments of the present disclosure may allow for the cutters 57 to be placed anywhere a distance D' from the steerable actuator 53 or on the steerable actuator 53 (i.e., the distance D' is zero) such that the distance D from the cutters 57 to the upper most hole defining cutting element 79 of the drill bit 18 is equal to or greater than 4 inches (10 cm), 6 inches (15 cm), or 9 inches (23 cm). In some embodiments, the cutters 57 may be attached directly to the actuatable bias pad 54. Additionally, one skilled in the art will appreciate how the cutters 57 may be laterally moveable or static with respect to the tool body 47. For example, while secondary pads, for example, may be static in one or more embodiments, the secondary pads or other structure to which cutters 57 are attached, may also be actuatable to move laterally or radially outward.

In some embodiments, the cutters 57 may cut the wellbore 22 at a diameter that is substantially equal to or greater than a gage diameter (GD) of gage cutters 78 of the drill bit 18. However, cutters 57 may also be placed under gage and then actuated to move laterally to GD or over GD. The cutters 57 may be fixed on the secondary pads (55A, 55B) and still sit under gage of GD. When the outer diameter of the cutters 57 is greater than the GD of the gage cutters 78 of the drill bit 18, the cutters 57 may be used as a hole-opener. The cutter 57 may be moved laterally/radially to be at any gage diameter needed to further cut the wellbore 22. Additionally, when the cutters 57 or the structure to which the cutters 57 are attached is moveable, the controller used to actuate the steering actuator 53 may also be used to move the cutters 57. Alternatively, an additional controller, or a controller located in another tool of the BHA may be used to move the cutters.

In one or more embodiments, the cutters 57 used in this or any other embodiment may be polycrystalline diamond compact (PDC) cutters, i.e., cylindrical compacts of a polycrystalline diamond layer on a substrate which may be brazed or otherwise attached to the RSS tool, e.g., to the secondary pads. Further, while cutters 57 are illustrated as PDC shear cutters, other types of cutting elements and other geometries of cutting elements may be used in any of the disclosed embodiments, including, for example, cutting elements having a substantially pointed end, or other non-planar cutting ends (such as with an elongated apex extending from a peripheral edge of the cutting element (at or substantially at the diameter of the cutting element) radially inward toward the center of the cutter)).

Figure 7:
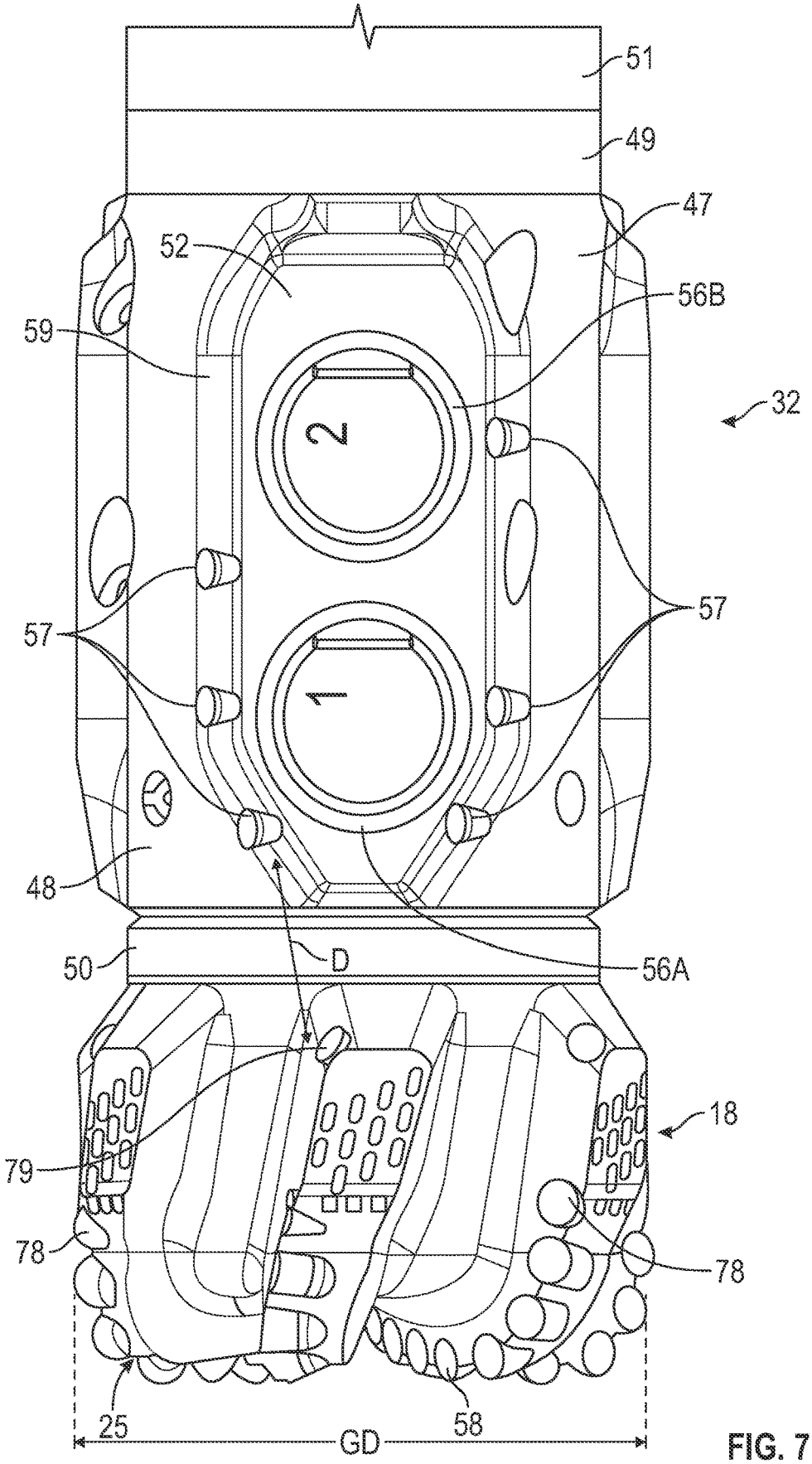
FIG. 7 illustrates a rotary steerable system according to one or more embodiments of the present disclosure.

FIG. 7 illustrates the rotary steerable tool 32 one or more steering assemblies 52. In some embodiments, the one or more steering assemblies 52 may have a plurality of piston assemblies 56A, 56B and steering actuators, e.g., pistons 1, 2 as illustrated. In some embodiments, the pistons 1, 2 are actuated by mud that is diverted from the primary flow through the BHA and extended to press on the borehole to steer the drill bit 18. For example, a first piston assembly 56A is positioned within the one or more steering assemblies 52 to be a first length away from the bit face 25 of the drill bit 18. Additionally, a second piston assembly 56B is positioned within the one or more steering assemblies 52 to be a second length away from the bit face 25 of the drill bit 18, where the second length is greater than the first length of the first piston assembly 56A. A first piston 1 is disposed within the first piston assembly 56A and a second piston 2 is disposed within the second piston assembly 56B. Each piston 1, 2 may be selectively (or in unison) actuated to provide the steering offset to the drill bit 18 to drill the curve in the wellbore. An end face of each pistons 1, 2 that contacts the wellbore may have a surface that includes a hard material such as tungsten carbide or diamond to prolong the life of the pistons 1, 2. Further shown in FIG. 7, the cutters 57 may be placed on the upset feature 59, which surrounds and delimits the steering assembly 52. The upset feature 59 may also define a junk slot area between adjacent steering assemblies for the mud to transport cuttings to the surface.

As illustrated in FIG. 7, in one or more embodiments, the cutters 57 may be placed below piston 1, between pistons 1, 2, or above piston 2. Further, cutters 57 may be placed at a diameter that is substantially equal to or greater than the gage diameter (GD) of gage cutters 78. For example, an upper piston 2 may be on a larger nominal diameter such that it can use the cutters 57 intermediate to the pistons 1, 2 as its L1 reference (see Equation 1). In such a case, the upper piston 2 pushes off a freshly cut hole and not one abraded by a lower piston 1. In this case, both pistons (1, 2) may achieve the DLS with their own L1. Further, while cutters 57 may be disposed on steering assembly 52, cutters may be placed elsewhere on the tool body 47 of the rotary steerable tool 32 such that there is distance between the cutters 57 and the steering actuators (i.e., pistons 1,2) of the steering assembly 52. In some embodiments, the cutters 57 are above the drill bit 18 at a distance D equal to or greater than 4 inches (10 cm), 6 inches (15 cm), or 9 inches (23 cm) from the upper most hole defining cutting element 79 of the drill bit 18. For example, the cutters 57 may be on the lower end of steering assembly 52 (i.e., adjacent to the lower connection end 48 of the rotary steerable tool 32, which is coupled to the proximal end 50 of the drill bit 18 opposite of the bit face 25. While FIG. 7 shows the cutters 57 adjacent to the lower connection end 48, the cutters 57 are not limited to being adjacent to the lower connection end 48. In some embodiments, the cutters 57 may be disposed on the upper end of the steering assembly 52 (i.e., adjacent to the upper connection end 49 of the rotary steerable tool 32, which is coupled to the downhole tool 51 of the BHA). Additionally, the cutters 57 may be elsewhere on the tool body 47 in between the upper connection end 49 and the lower connection end 48.

As described above, the cutters 57 of the present disclosure may be placed on the rotary steerable tool 32, such as in FIGS. 3-7. The BHA has various diameters based on an outer diameter of the tools in the BHA. In one aspect, a first diameter is the gage diameter of the drill bit and a second diameter is a diameter of the cutters on the rotary steerable tool. Additionally, there is a distance D between the first diameter (i.e., drill bit) and second diameter (i.e., cutters) and the area within that distance may be a connection interface, a passive gage area or serve some other purpose (e.g., sensing). In some embodiments, the distance D between the first diameter (i.e., drill bit) and second diameter (i.e., cutters) is equal to or greater than 4 inches (10 cm), 6 inches (15 cm), or 9 inches (23 cm). Additionally, there is a distance D' between the second diameter and the steering pads or actuators. There is also a distance D" between the first diameter (i.e., drill bit) and the steering pads or actuators. D' is less than D".

However, in some embodiments, as the distance between the first diameter (i.e., drill bit) and second diameter (i.e., cutters) increases, a relief on the passive gage area needs to be pulled inwards to allow for the target DLS. The area between the first diameter (i.e., drill bit) and the second diameter (i.e., cutters) may be outwardly actuatable to modify a lateral aggressivity and DLS capability of the drill bit. In one aspect, the second diameter (i.e., cutters) is between the one or more steering actuators of the rotary steerable tool and drill bit, and thus, as applied to Equation 1, there is an improved DLS capability for the described system. In some embodiments, the distance D includes a portion having a diameter less than the first diameter (i.e., drill bit).

In some embodiments, the second diameter (i.e., cutters) is above of the one or more steering actuators of the rotary steerable tool. In such a case, the placement of the second diameter (i.e., cutters) above the one or more steering actuators does not assist in increasing the DLS since the L1 distance (see Equation 1) in this case would be from the drill bit to the one or more steering actuators. With the cutters above the one or more steering actuators, the cutters may be used as a protective element for features of the rotary steerable tool that if damaged, the damage would lead to a loss of steering DLS. Additionally, the cutters, when above the one or more steering actuators, may be used for a non-steering function such as opening the wellbore (e.g., under reaming) or improving wellbore quality. Further, in some embodiments, the cutters may be actuatable or be placed on the one or more steering actuators.

Furthermore, methods of the present disclosure may include use of the rotary steerable tool 32 and other structures, such as in FIGS. 1 and 3-7. Initially, the rig lowers the drill bit into the surface of the earth, thereby drilling the wellbore with the drill bit. As the drill bit continues drilling the wellbore to a further depth, the drill string and BHA, which are connected to the drill bit, may be rotated. Additionally, the rotary steerable tool of BHA is rotating within the wellbore. Based on when a driller of the rig needs to steer to reach a target area, the driller may selectively actuate the rotary steerable tool to deflect the drill bit in a direction from the wellbore. Then, the drill bit is deflected in a deviation different from the current trajectory (e.g., an initial vertical axis of the wellbore) to have a curved or horizontal axis in the wellbore, thereby drilling a curved hole within the wellbore. The selectively actuating of the rotary steerable tool may be done by sending a signal from the rig to the rotary steerable tool or control unit, e.g., by an electrical signal via wired drill pipe, by telemetry, or by other known means. Once the rotary steerable tool is traveling through the curved portion of the wellbore, the cutters of the rotary steerable tool may further cut and/or clean the curved portion of the wellbore. The cutters may be selectively actuated to be retracted or extended to the desired diameter for cutting or not cutting the curved hole. Furthermore, ledges may form in the curved hole. Often when drilling, ledges are formed in the borehole (i.e., the borehole wall is not smooth). The ledges create a hard angle in the curved hole and make the wellbore more less uniform and more prone to issues such as stuck pipe. If a ledge is formed, the cutters cutting the curved hole may also cut the ledge formed in the curved hole. The cutters may also be used as under-reamers or hole openers to change the diameter of the wellbore from the drill bit. For example, the drill bit may be configured to drill a hole diameter that is less than the intended hole diameter. The cutters adjacent to the steering actuators may then ream the drill bit to the desired hole size. The amount the cutters used adjacent to the steering actuators in a wellbore may be predetermined based on a target angle or depth; however, the parameters and goals of the well may change, and thus, the usage of cutters may be changed in real time (when actuatable cutters are used) to increase or decrease the density and diameter of the cutting structure adjacent to the steering actuators.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

It should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A rotary steerable tool, comprising:

a tool body, wherein the tool body has an upper connection end and a lower connection end, the lower connection end including a pin connection or a box connection;

a sleeve removably attached to the tool body;

at least one steering assembly carried by the tool body and extending radially from the tool body, the at least one steering assembly comprising at least one steering actuator configured to extend radially beyond other portions of the at least one steering assembly; and at least one cutter disposed on the sleeve, wherein the at least one cutter is positioned below and a distance from the at least one steering actuator, the at least one cutter positioned between the upper connection end and the lower connection end of the tool body carrying the at least one steering assembly, wherein the rotary steerable tool, excluding the at least one cutter, has a first diameter when the at least one steering actuator is not extended, and the at least one cutter is at a diameter greater than the first diameter.

2. The rotary steerable tool of claim 1, wherein the at least one steering assembly comprises at least one piston assembly configured to house the at least one steering actuator.

3. The rotary steerable tool of claim 2, wherein the at least one steering actuator comprises a piston within the at least one piston assembly to extend or retract to provide a steering offset.

4. The rotary steerable tool of claim 1, wherein the at least one steering actuator comprises an actuatable bias pad.

5. The rotary steerable tool of claim 1, wherein the at least one cutter is radially moveable.

6. The rotary steerable tool of claim 1, wherein the sleeve is operationally connected with the lower connection end of the tool body.

7. The rotary steerable tool of claim 1, further comprising a cutting tool coupled directly or indirectly to the lower connection end of the tool body, the cutting tool including one or more outermost cutting elements having a cutting tip at a fixed radial position, wherein a cutting tip of the at least one cutter has a radial position that is equal to or greater than the fixed radial position of the one or more outermost cutting elements.

8. A bottom hole assembly, comprising:

a drill bit at a distal end of the bottom hole assembly, the drill bit having:

a bit body; and a plurality of cutting elements thereon, the plurality of cutting elements including at least one uppermost hole defining cutting element; and a steering unit coupled to the drill bit and above the at least one uppermost hole defining cutting element, the steering unit comprising:

a steering assembly carried by and extending from a steering unit body, the steering assembly including at least one steering actuator configured to extend beyond other portions of the steering assembly;

at least one cutter disposed on the steering unit body a distance from the at least one steering actuator, the at least one cutter being configured to cut at the same diameter as the at least one uppermost hole defining cutting element or configured to cut at a diameter greater than the at least one uppermost hole defining cutting element; and a removable sleeve, wherein the at least one cutter is mounted to the removable sleeve.

9. The bottom hole assembly of claim 8, a distance between the at least one cutter and the uppermost hole defining cutting element of the drill bit being equal to or greater than 6 inches (15 cm).

10. The bottom hole assembly of claim 8, wherein the steering unit is removably coupled to the drill bit.

11. The bottom hole assembly of claim 8, the at least one cutter being axially aligned with, or above, the at least one steering actuator.

12. The bottom hole assembly of claim 8, the at least one steering actuator including at least one of a piston or a bias pad.

13. The bottom hole assembly of claim 8, wherein the distance of the at least one cutter from the at least one steering actuator is less than a distance of the at least one cutter from the at least one uppermost hole defining cutting element.

14. The bottom hole assembly of claim 8, the steering unit including one or more pads defining at least one fixed surface below and above the at least one steering actuator.

15. The bottom hole assembly of claim 8, the at least one cutter being below the at least one steering actuator.

16. A bottom hole assembly, comprising:

a drill bit at a distal end of the bottom hole assembly, the drill bit having:

a bit body; and a plurality of cutting elements thereon, the plurality of cutting elements including at least one uppermost hole defining cutting element; and a steering unit coupled to the drill bit and above the at least one uppermost hole defining cutting element, the steering unit comprising:

a steering assembly carried by and extending from a steering unit body, the steering assembly including at least one steering actuator configured to extend beyond other portions of the steering assembly;

at least one cutter disposed on the steering unit body a distance from the at least one steering actuator, the at least one cutter being configured to cut at the same diameter as the at least one uppermost hole defining cutting element or configured to cut at a diameter greater than the at least one uppermost hole defining cutting element; and at least one passive surface of a fixed diameter positioned adjacent the at least one steering actuator, the at least one cutter being mounted to the at least one passive surface.

17. The bottom hole assembly of claim 16, a distance between the at least one cutter and the uppermost hole defining cutting element of the drill bit being equal to or greater than 6 inches (15 cm).

18. The bottom hole assembly of claim 16, wherein the steering unit is removably coupled to the drill bit.

19. The bottom hole assembly of claim 16, the at least one steering actuator including at least one of a piston or a bias pad.

20. The bottom hole assembly of claim 16, wherein the distance of the at least one cutter from the at least one steering actuator is less than a distance of the at least one cutter from the at least one uppermost hole defining cutting element.

21. The bottom hole assembly of claim 16, the at least one cutter being axially aligned with, or above, the at least one steering actuator.

22. The bottom hole assembly of claim 16, the at least one cutter being below the at least one steering actuator.

* * * * *